United States Patent [19]

Konrad

[11] Patent Number: 4,815,049

[45] Date of Patent: Mar. 21, 1989

[54] DISAPPEARING BAFFLE FOR SONAR ARRAYS

[75] Inventor: William L. Konrad, East Lyme, Conn.

[73] Assignee: The United States of America as represented by the Secretary of the Navy, Washington, D.C.

[21] Appl. No.: 239,499

[22] Filed: Sep. 1, 1988

[51] Int. Cl.[4] ..... H04R 17/00

[52] U.S. Cl. ..... 367/176; 367/1; 181/0.5; 181/284

[58] Field of Search ..... 181/115, 118, 120, 402, 181/152, 196, 197, 198, 210, 284, 288, 290, 286, 292, 0.5; 367/1, 141, 144, 152, 153, 154, 171, 172, 176, 901, 191

[56] References Cited

U.S. PATENT DOCUMENTS

| | | | |
|---|---|---|---|
| 3,014,198 | 12/1961 | Harris | 367/151 |
| 3,021,504 | 2/1962 | Toulis | 367/176 |
| 3,302,748 | 2/1967 | Reed | 181/152 |
| 3,907,062 | 9/1975 | Brigham et al. | 181/0.5 |
| 4,399,526 | 8/1983 | Eynck | 367/153 X |

*Primary Examiner*—Brian S. Steinberger
*Attorney, Agent, or Firm*—Michael J. McGowan; Arthur A. McGill; Prithvi C. Lall

[57] ABSTRACT

A selectively transparent baffle means for controlling beam pattern dispersal or direction, further comprising a plurality of parallel, vertically oriented, compliant tubes each of which attach to one of two header tubes at one end while the opposite ends are open to sea pressure. The headers provide air fill or vent.

3 Claims, 1 Drawing Sheet

DISAPPEARING BAFFLE FOR SONAR ARRAYS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to sonar beam steering and more particularly to a means of achieving a desired unidirectional beam pattern which selectively directs the beam pattern axis to port, starboard, or fore and aft by use of parallel, compliant tube baffles which may be controllably made to disappear from the perspective of the transmitted acoustic signal.

(2) Description of the Prior Art

It is well known that many sonar transmitting or receiving transducers or arrays of transducers require that transmission or reception be confined to a single direction at any one time. A single transducer produces at near omnidirectional beam pattern, especially at relatively low frequencies, while a two-dimensional array of transducers, when steered broadside or near broadside, produces a bidirectional beam pattern typically directed to port and starboard simultaneously. The use of a soft, low impedance reflector behind a transducer or array provides an effective means of obtaining a unidirectional beam pattern. As a result of the pressure doubling resulting from such a soft baffle when spaced $\frac{1}{4}$ wavelength ($\lambda/4$) from the transducer, a 6 dB gain can be obtained along the maximum response axis (MRA) of the array. This gain is the result of a 6 dB increase in directivity index ($N_{DI}$) over that of a bare omnidirectional transducer. Two other methods of obtaining a unidirectional beam pattern are a single transducer spaced close to a hard, high impedance baffle or the use of two transducers spaced about $\frac{1}{4}$ wavelength apart with the phase of the feed to the rear transducer leading the phase to the front transducer by 90°. The beam pattern for the hard baffle case however produces a cardioid pattern which approximates a hemisphere and exhibits a 3 dB $N_{DI}$. Further, the hard baffle requires a thick and heavy metal plate. The two transducer approach, which develops 3 dB of $N_{DI}$ with a cardioid pattern, allows selective transmission to port, starboard or endfire but at the price of requiring twice as many transducers and twice the power for the same source level as required for a single transducer and a soft baffle. The soft baffle has, however, the disadvantage of being unable to steer endfire; the maximum off-broadside steering angle being about 55°. Further, if a single panel of transducers is used, a conventional baffle on one side will obviously allow transmissions only toward the opposite side.

SUMMARY OF THE INVENTION

Accordingly, it is a general purpose and object of the present invention to provide a sonar baffle which can be made to selectively disappear or appear relative to acoustic signal transmission.

It is a further object that such baffle be light weight.

Another object is that such baffle be low in cost.

Still another object is that such baffle employ compliant tubes which may be selectively, seawater or gas filled as desired.

These objects are accomplished with the present invention by providing a selectively transparent baffle means for controlling beam pattern dispersal or direction, further comprising a plurality of parallel compliant tubes which each attach to a header tube at one end while the opposite end is open to sea pressure. The header provides air fill or vent.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
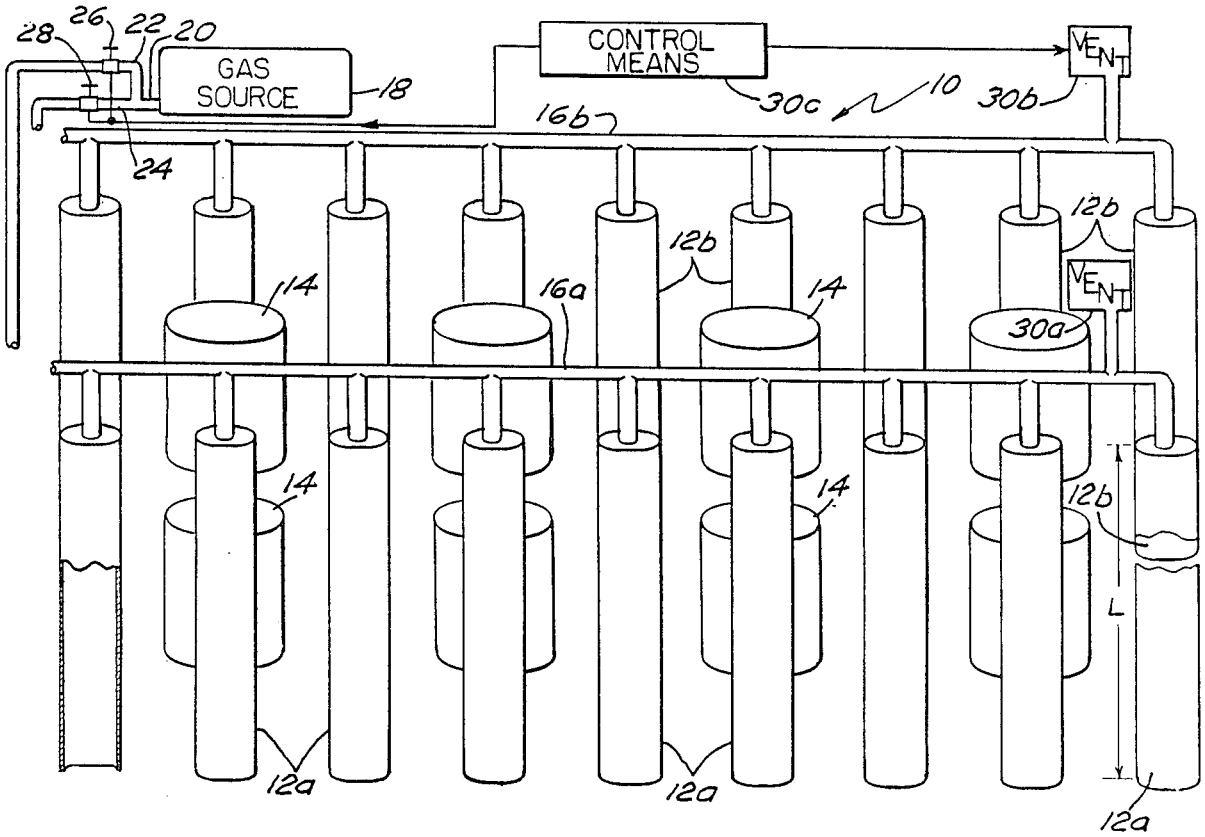
FIG. 1 shows an isometric view of a disappearing baffle system disposed about a sonar transducer array.

Referring now to FIG. 1 there is shown a disappearing baffle system 10 according to the present invention. Baffle system 10 comprises a first plurality of coplanar compliant tubes 12*a* and a second plurality of coplanar compliant tubes 12*b*, one each plurality being disposed to either side of an array of coplanar transducers 14. The transducer plane and each of the tube planes are disposed parallel with respect to each other. Tubes 12*a* and 12*b* are oriented vertically, being evenly spaced parallel to each other a preselected distance "x" apart. Headers 16*a* and 16*b* connect to the top of each tube 12*a* and 12*b* respectively while the bottoms of each tube 12*a* and 12*b* remain open and exposed to sea water. While several means may be employed to render the baffle ineffective, the preferred approach is to allow normally air filled compliant tubes to fill with water when their reflective effect is not desired. Such an array configuration might then consist of a sandwich with the array panel flanked by a soft baffle on both sides. To steer to starboard the starboard baffle is disabled, to steer port, disable the port baffle, and to steer endfire, both baffles are effectively removed. One configuration uses vertical compliant tubes 12*a* and 12*b* so that air introduced from gas source 18, preferably at the top end, forces the water out the bottom. Conversely, venting the top of tubes 12*a* and 12*b* allows water to flow in from the bottom. Gas source 18 provides air or the like to outlet tube 20. Tube 20 feeds tubes 22 and 24 which connect to shut-off valves 26 and 28 respectively. Valves 26 and 28 in turn connect to headers 16*a* and 16*b* respectively. Venting is provided by opening venting means 30*a* and 30*b* to the atmosphere allowing the ambient water pressure to force the air upward and out of the tubes. Valves 26 and 28, and venting means 30*a* and 30*b* can be operated locally or remotely. Remote operation may be accomplished using any of several well known valve control means shown generally as 30*c*.

Figure 2:
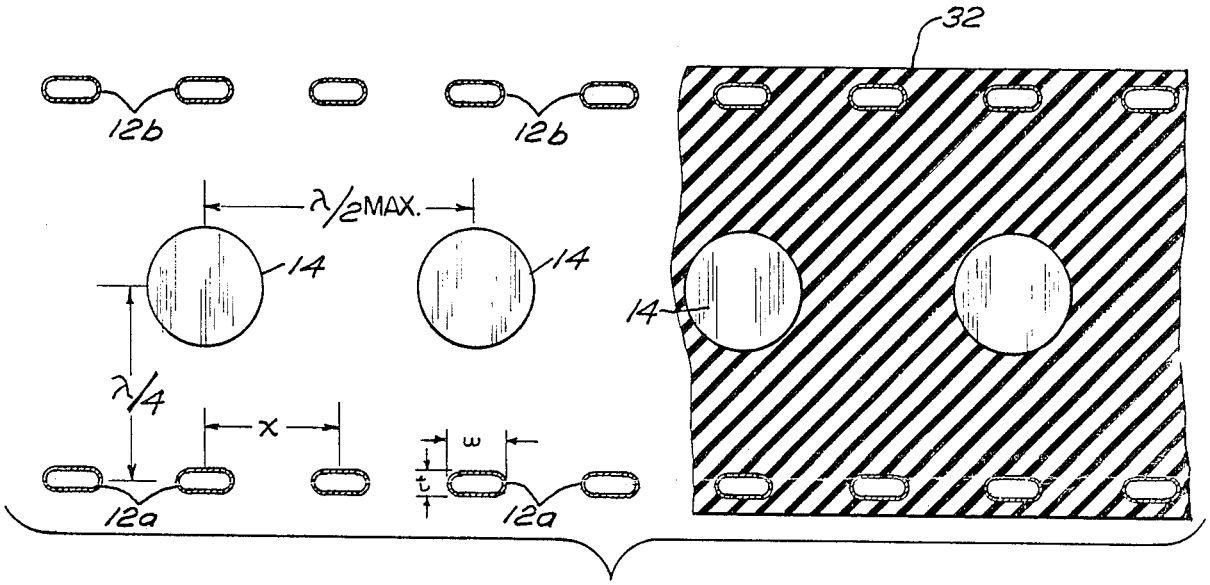
FIG. 2 shows a cross sectional top view of the system of FIG. 1.

FIG. 2 shows a top view of baffle system 10 of FIG. 1. Compliant tubes 12*a* and 12*b* flank the array of transducer elements 14. Typical spacing between adjacent transducer elements is one half wavelength ($\lambda/2$) at the midband frequency of the array. The spacing between the plane of the elements and the plane of the tubes is typically one quarter wavelength (λ/4) at the midband frequency. Center-to-center spacing "x" between tubes will usually be one quarter wavelength (λ/4) or less. Compliant tube dimensions "w" and "t" determine the resonant frequency of the tubes which are preselected to function near the midband operating frequency for maximum tube effectiveness. Baffle system 10 may be either free standing or may be embedded in an elastomeric material 32 such as a urethane or the like which has an impedance close to that of water.

The advantages of the disappearing baffle, in particular a disappearing soft or low impedance baffle, is that a selective, electrically steered, unidirectional beam pattern is obtained with lightweight baffles using only a two dimensional array. The result is a considerable savings in system weight and cost.

What has thus been described is a selectively transparent baffle means for controlling beam pattern dispersal or direction, further comprising a plurality of parallel compliant tubes each of which attach to a header tube at one end while the opposite end is open to sea pressure. The header provides air fill or vent.

Obviously many modifications and variations of the present invention may become apparent in light of the above teachings. For example: An obvious alternative would be the mechanical removal of the baffles in venetian blind fashion when not required. A second alternative would use compliant tubes which would collapse under sea pressure when not wanted and would be blown up with gas when required. A third alternative would require the compliant tubes to be designed in such a manner so as to become ineffective in a selected frequency sub-band within the overall transducer bandwidth. It is also noted that while the tubes in the preferred embodiment are disposed vertically, they may also be oriented at other angles without deviating from the present invention.

In light of the above, it is therefore understood that within the scope of the appended claims, the invention may be practiced otherwise than as specifically described.

What is claimed is:

1. A baffle for an array of transducers disposed along a common transducer plane in water, comprising;

a first plurality of vertically disposed hollow tubes having first and second ends, said first plurality of tubes being aligned in a first tube plane, said first tube plane being generally parallel to said transducer plane and spaced a distance λ/4 away therefrom, each said tube being spaced a preselected distance "x" away from adjacent tubes;

a second plurality of vertically disposed hollow tubes having first and second ends, said second plurality of tubes being aligned in a second tube plane, said second tube plane being generally parallel to said transducer plane and said first tube plane and spaced a distance λ/4 away from said transducer plane on the opposite side thereof, each said tube being spaced a preselected distance "x" away from adjacent tubes;

a first header tube, fixedly attached to said first end of each of said first plurality of tubes while said second end of said tubes remains open to said water;

a second header tube, fixedly attached to said first end of each of said second plurality of tubes while said second ends of said tubes remain open to said water;

first venting means, attached to said first header, for selectively venting said first plurality of tubes, second venting means, attached to said second header, for selectively venting said second plurality of tubes;

a gas source means, fixedly attached to said first and second headers, for providing pressurized gas to said first and second headers; and control means, attached to said venting means and said gas source means, for controlling the venting and filling of said tubes.

2. A baffle according to claim 1 wherein each of said first and second plurality of tubes have preselected dimensions "w" and "t" chosen such that the resonant frequency of said tubes function near the midband of a preselected operating frequency.

3. A baffle according to claim 2 wherein said first and second plurality of tubes is embedded in an elastomeric material having an impedance chosen to be substantially the same as the impedance of said water, said second ends of each of said first and second plurality of hollow tubes remaining exposed to said water.

* * * * *